United States Patent [19]

Shiga et al.

[11] 4,347,310

[45] Aug. 31, 1982

[54] HEAT DEVELOPABLE SILVER IMAGE FORMING MATERIALS

[75] Inventors: Tetsuo Shiga, Fuji, Japan; Masaru Ozaki, Drexel Hill, Pa.; Tatsumi Arakawa, Fuji, Japan; Takeo Kimura, Fuji, Japan; Hidehiko Kobayashi, Fuji, Japan

[73] Assignee: Asahi Kasei Kogyo Kabushiki Kaisha, Osaka, Japan

[21] Appl. No.: 258,859

[22] Filed: Apr. 29, 1981

Related U.S. Application Data

[63] Continuation of Ser. No. 113,415, Jan. 18, 1980, abandoned, which is a continuation of Ser. No. 951,546, Oct. 16, 1978, abandoned.

[30] Foreign Application Priority Data

Oct. 14, 1977 [JP] Japan ..... 52-122479

[51] Int. Cl.[3] ..... G03C 1/02

[52] U.S. Cl. ..... 430/620; 430/599; 430/600; 430/603; 430/607; 430/611; 430/613; 430/614; 430/618; 430/619

[58] Field of Search ..... 96/114.1, 107, 109; 430/599, 600, 603, 607, 611, 614, 618, 619, 620, 345, 613

[56] References Cited

U.S. PATENT DOCUMENTS

| | | | |
|---|---|---|---|
| 2,324,123 | 7/1943 | Weissberger | 430/489 |
| 3,023,103 | 2/1962 | Dersch et al. | 430/614 |
| 3,567,454 | 3/1971 | Willems et al. | 430/611 |
| 3,649,280 | 3/1972 | King et al. | 430/617 |
| 3,764,329 | 10/1973 | Lee | 430/353 |
| 3,802,888 | 4/1974 | Willits | 430/203 |
| 3,910,792 | 10/1975 | Baldassarri | 430/607 |
| 3,935,012 | 1/1976 | Eian | 430/203 |
| 3,982,948 | 9/1976 | Sato et al. | 430/614 |

FOREIGN PATENT DOCUMENTS

| | | |
|---|---|---|
| 1161777 | 8/1969 | United Kingdom . |
| 1400244 | 7/1975 | United Kingdom . |
| 1466614 | 3/1977 | United Kingdom . |

OTHER PUBLICATIONS

Kalenda, et al., Abstract of SN 788,076, filed 12/1968, published in 861 OG 1021, on 4/1969.

*Primary Examiner*—Won H. Louie, Jr.
*Attorney, Agent, or Firm*—Sprung, Horn, Kramer & Woods

[57] ABSTRACT

A heat developable silver image forming material comprising:

(a) an organic silver salt oxidizing agent;
(b) a compound or a composition capable of forming a photosensitive silver compound by reaction with the organic silver salt oxidizing agent (a);
(c) a reducing agent for silver ion; and
(d) a compound having a unit of $$-NH-\overset{\overset{\displaystyle NH}{\|}}{C}-NH-.$$

8 Claims, No Drawings

HEAT DEVELOPABLE SILVER IMAGE FORMING MATERIALS

This is a continuation of application Ser. No. 113,415, filed Jan. 18, 1980 now abandoned, which is a continuation of Ser. No. 951,546, filed Oct. 16, 1978, now abandoned.

BACKGROUND OF THE INVENTION 1. Field of the Invention

This invention relates to a heat developable silver image forming material. More particularly, it relates to a heat developable silver image forming material having good sensitivity and storage stability capable of forming a silver image thereon by reduction of the silver ion of an organic silver salt oxidizing agent with a reducing agent for silver ion by heat development.

2. Description of the Prior Art

Conventional wet processing photosensitive materials containing a silver halide require complicated and time consuming processes using various treating chemicals in obtaining stable images and further, the chemicals used give rise to a pollution problem. Accordingly, in order to avoid these disadvantages there have been made many attempts to develop photosensitive materials having high sensitivity capable of forming stable images thereon only by dry processing without using treating chemicals. For example, U.S. Pat. No. 3,152,902 describes a heat developable silver image forming material comprising an organic silver salt having rather good light stability, a reducing agent for silver ion and a photosensitive silver halide. U.S. Pat. No. 3,457,075 describes a heat developable silver image photosensitive material whose sensitivity is increased by the photosensitive silver halide formed by halogenation of a small portion of the organic silver salt. However, the sensitivity of these photosensitive materials is still insufficient for practical purposes and the storage stability thereof are markedly low. Further, U.S. Pat. Nos. 3,802,888 and 3,764,329 describe heat developable silver image forming materials which are non-photosensitive under normal light conditions and can be rendered photosensitive by the preliminary heating prior to the imagewise exposure to light. The heat developable silver image forming materials of this type are hereinafter referred to as "post activatable type heat developable silver image forming materials". These post activatable type heat developable silver image forming materials can be advantageously prepared and handled in normal light conditions, but according to U.S. Pat. No. 3,802,888, their minimum optical density (fog density) increase when they are stored under normal light conditions, and hence their storage stability (shelf life) is still insufficient for practical purposes. The post activable type heat developable silver image forming materials described in U.S. Pat. No. 3,764,329 have higher storage stability but instead lower sensitivity than those of U.S. Pat. No. 3,802,888. In general, use of a sensitizer reduces the storage stability, increases the minimum optical density and decreases or, in some cases, increases the sensitivity. The change of the sensitivity due to their storage under normal light conditions is also undesirable for post activable type heat developable silver image forming materials.

Furthermore, the heat developable silver image forming materials produce images by reduction of the silver ion of an organic silver salt upon the imagewise exposure to light, followed by heat development and differs from conventional silver halide photosensitive materials in their image forming mechanism as well as in their compositions. Thus, it is well known in this field that the techniques for increasing the sensitivity or the storage stability of conventional silver halide photosensitive materials cannot be applied directly for heat developable silver image forming materials.

SUMMARY OF THE INVENTION

An object of this invention is to provide a heat developable silver image forming material having good sensitivity.

Another object of this invention is to provide a heat developable silver image forming materials having good storage stability under normal light conditions.

Accordingly, the present invention provides a heat developable silver image forming material comprising:

(a) an organic silver salt oxidizing agent;

(b) a compound or a composition capable of forming photosensitive silver compound by reaction with the organic silver salt oxidizing agent (a);

(c) a reducing agent for silver ion; and (d) a compound having a unit of $$-NH-\overset{\overset{\displaystyle NH}{\|}}{C}-NH-.$$

Thus, by using the above-described component (d) the sensitivity of the heat developable silver image forming materials of this invention can be increased. Further, with regard to the post activable type heat developable silver image forming materials of this invention, their sensitivity and storage stability under normal light conditions can be increased at the same time.

DETAILED DESCRIPTION OF THE INVENTION

The organic silver salt oxidizing agents which can be employed as component (a) in this invention include silver salts of long chain aliphatic carboxylic acids having 12 to 24 carbon atoms such as silver laurate, silver myristate, silver palmitate, silver stearate, silver arachidate and silver beherate; silver salts of organic compounds having an imino group such as benztriazole silver salt, benzimidazole silver salt, carbazole silversalt and phthalazinone silver salt; silver salts of sulfur containing compounds such as S-alkylthioglycollates; silver salts of aromatic carboxylic acids such as silver benzoate and silver phthalate; silver salts of sulfonic acids such as silver ethanesulfonate; silver salt of sulfinic acids such as silver o-toluenesulfinate; silver salts of phosphoric acids such as silver phenylphosphate; silver barbiturate; silver saccharate; silver salts of salicylaldoxime; and any mixtures thereof. Of these compounds, silver salts of long chain aliphatic carboxylic acids having 12 to 24 carbon atoms are preferred.

The amount of the organic silver salt oxidizing agent which can be employed in this invention typically ranges from about 0.1 $g/m^2$ to about 50 $g/m^2$ of the support area of the dry image forming material. A preferred amount of the organic silver salt oxidizing agent ranges from about 1 $g/m^2$ to about 10 $g/m^2$ of the support area of the dry image forming material.

The compounds or the compositions capable of forming a photosensitive silver compound by reaction with the organic silver salt oxidizing agent (a) which can be employed as component (b) in this invention includes (I) silver halides, (II) inorganic halides, (III) metal complexes containing a halogen atom, (IV) onium halides, (V) halogenated hydrocarbons, (VI) organic haloamides having a unit of -CONX- or -$SO_2$NX-, wherein X represents a chlorine atom, a bromine atom or an iodine atom, (VII) iodine, (VIII) compounds or compositions comprising a halogen atom as a halogen component and an organic component containing an element of the IV group, the V group or the VI group of the Periodic Table except the sulfur whose atomic number is 14 or more, and any mixtures thereof.

The silver halides (I) used in this invention include silver chloride, silver bromide and silver iodide.

The inorganic halides (II) includes the compounds of the formula $MX_n$, wherein M is H, $NH_4$ or a metal atom; X is Cl, Br or I; in case of M being H or $NH_4$ n is 1 and in case of M being the metal atom n is its valence; and the metal atom is lithium, sodium, potassium, rubidium, cesium, copper, gold, beryllium, magnesium, calcium, strontium, barium, zinc, cadmium, mercury, aluminum, gallium, indium, lathanum, ruthenium, thallium, germanium, tin, lead, antimony, bismuth, chromium, molybdenum, tungsten, manganese, rhenium, iron, cobalt, nickel, rhodium, palladium, osmium, iridium, platinum or cerium.

Specific examples of the metal complexes containing a halogen atom (III) include $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RhCl_6$ and $(NH_4)_3RhBr_6$.

Specific examples of the onium halides (IV) include quaternary ammonium halides such as trimethylphenylammonium bromide, cetylethyldimethylammonium bromide and trimethylbenzylammonium bromide; quaternary phosphonium halides such as tetraethylphosphonium bromide; and tertiary sulfonium halides such as trimethylsulfonium iodide.

Specific examples of the halogenated hydrocarbons (V) include iodoform, bromoform, tetraiodocarbon and 2-bromo-2-methylpropane.

Specific examples of the organic haloamides (VI) include N-chlorosuccinimide, N-bromosuccinimide, N-iodosuccinimide, N-chlorophthalimide, N-bromophthalimide, N-iodophthalimide, N-chlorophthalazinone, N-bromophthalazinone, N-iodophthalazinone, N-chloracetamide, N-bromoacetamide, N-iodoacetamide, N-chloroacetanilide, N-bromoacetanilide, N-iodoacetanilide, 1-chloro-3,5,5-trimethyl-2,4-imidazolidinedione, 1-bromo-3,5,5-trimethyl-2,4-imidazolidinedione, 1-iodo-3,5,5-trimethyl-2,4-imidazolidinedione, 1,3-di-chloro-5,5-dimethyl-2,4-imidazolidinedione, 1,3-dibromo-5,5-dimethyl-2,4-imidazolidinedione, 1,3-diiodo-5,5-dimethyl-imidazolidinedione, N,N-dichlorobenzenesulfonamide, N,N-dibromobenzenesulfonamide, N-bromo-N-methyl-benzenesulfonamide, N-chloro-N-methylbenzenesulfonamide, N,N-diiodobenzenesulfonamide, N-iodo-N-methyl-benzenesulfonamide, 1,3-dichloro-4,4-dimethylhydantoin, 1,3-dibromo-4,4-dimethylhydantoin and 1,3-diiodo-4,4-dimethylhydantoin.

Specific examples of the compounds or compositions (VIII) include

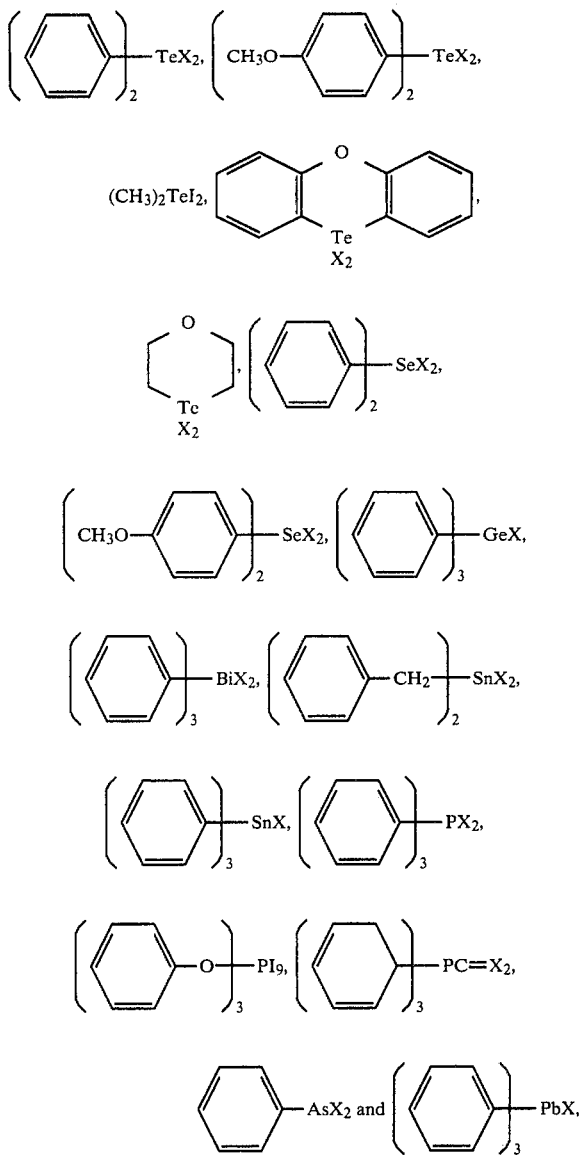

wherein X represents a chlorine atom, a bromine atom or an iodine atom; and mixtures of the compounds (II) to (III) with the compounds shown below;

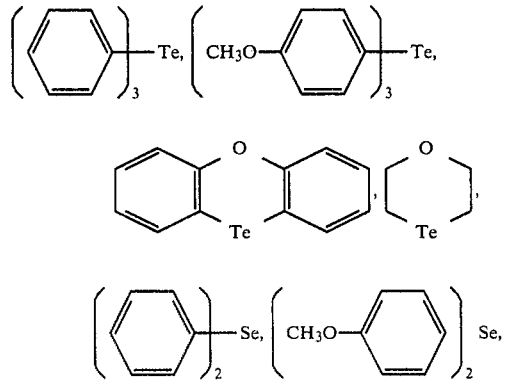

-continued

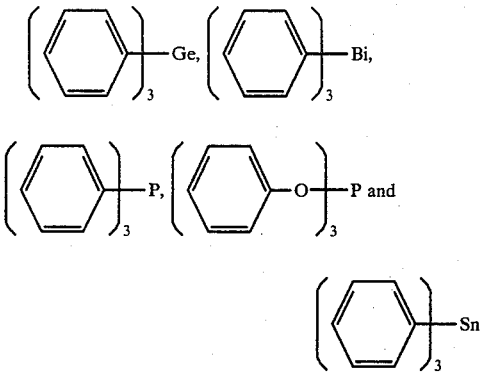

Of these compounds and compositions (II) to (VIII), the compounds and compositions (VI), (VII) and (VIII) are preferably employed as the component (b) for the post activatable type heat developable silver image forming materials according to this invention.

The amount of the compounds or the compositions capable of forming a photosensitive silver compound by reacton with the organic silver salt oxidizing agent which can be employed in this invention typically ranges from about 0.1 mole to about 0.5 mole, and preferably 0.05 mole to 0.3 mole, based on the mole of the organic silver salt oxidizing agent.

The reducing agents for silver ion which can be used as component (c) in this invention sterically hindered phenols in which a sterically bulky grop is bonded to the carbon atom adjacent to the carbon atom bonded to the hydroxyl group; substituted phenols; hydroquinones; hydroquinone ethers; and other reducing agents for conventional wet processing silver salt type photosensitive materials.

Specific examples of reducing agent for silver ion include 2,6-di-tert-butyl-4-methylphenol, 2,2'-methylenebis(4-methyl-6-tertbutylphenol), 2,6-methylenebis(2-hydroxy-3-tert-butyl-5-methylphenyl)4-methylphenol, 2,2'-methylenebis(4-ethyl-6-tert-butylphenol), 2,4,4-trimethylpentylbis(2-hydroxy-3,5-dimethylphenyl)methane, 2,2'-methylenebis[4-methyl-6-(1-methylcyclohexyl)phenol, 2,5-di-tert-butyl-4-methoxyphenol, p-phenylphenol, p-methoxyphenol, p-aminophenol, catechol, pyrogallol, resorcin, bisphenol A, 2,4-dihydroxybenzoic acid, hydroquinone, methylhydroquinone, chlorohydroquinone, bormohydroquinone, phenylhydroquinone, tert-butylhydroquinone, tert-octylhydroquinone, 2,5-dimethylhydroquinone, 2,6-dimethylhydroquinone, methoxyhydroquinone, hydroquinone monobenzyl ether, α-naphthol, β-naphthol, 1,3-dihydroxynaphthalene, 2,2'-dihydroxy-1,1'-binaphthyl; phenidone, methyl gallate, and any mixtures thereof.

A preferred reducing agent for silver ion can be chosen depending upon the organic silver oxidizing agent employed. For example, with no organic silver salt oxidizing agent such as silver behenate which is relatively hard to be reduced, a relatively strong reducing agent for silver ion such as a sterically hindered phenol including 2,2'-methylenebis(4-ethyl-6-tert-butylphenol) is suitably chosen. On the other hand, with an organic silver salt oxidizing agent such as silver laurate which is relatively easy to be reduced, a relatively weak reducing agent for silver ion such as a substituted phenol including p-phenylphenol is suitably chosen, and with an organic silver salt oxidizing agent such as silver salt of benztriazole which is very hard to be reduced, a strong reducing agent for silver ion such as ascorbic acid is suitably chosen.

The amount of the reducing agent for silver ion may vary depending upon the organic silver salt oxidizing agent selected and the reducing agent for silver ion selected. In general, the amount of the reducing agent for silver ion used ranges from about 0.1 percent by weight to about 200 percent by weight based on the weight of the organic silver salt oxidizing agent. A preferred amount of the reducing agent for silver ion ranges from about 1 percent by weight to about 100 percent by weight.

The compounds having a unit of $$-NH-\overset{\overset{\displaystyle NH}{\|}}{C}-NH-$$

which can be employed as component (d) in this invention include the compounds of the formula, $$R^1NH-\overset{\overset{\displaystyle NH}{\|}}{C}-NHR^2$$

and their salts of hydrochloric acid, carbonic acid, acetic acid, sulfuric acid or phosphoric acid.

In the above-described formula, $$R^1NH-\overset{\overset{\displaystyle NH}{\|}}{C}-NHR^2,$$

$R^1$ and $R^2$ independently represent an aryl group; an aryl group substituted with an acetyl group, an amino group, an alkyl group or an alkoxy group; an alkyl group; an alkyl group substituted with an amino group, a carboxyl group, a mercapto group or an acetyl group; a cycloalkyl group; a S-, Se-, O- or N-containing heterocyclic group; an amidinyl group; a sulfanil group; a cyano group; an amino group; a nitro group and a hydrogen atom, and $R^1$ and $R^2$ may be coupled with each other to form a ring.

Preferably, $R^1$ and $R^2$ independently represents a phenyl group as the aryl group; an acetylphenyl, an aminophenyl group, a methylphenyl group, a methoxyphenyl and an ethoxyphenyl as the substituted aryl group; an alkyl group having 1 to 18 carbon atoms as the alkyl group; an alkyl group having 1 to 4 carbon atoms substituted with a carboxyl group, an amino group or a mercapto group as the substituted alkyl group, a cyclohexyl group as the cycloalkyl group; a 2-benzimidazolyl group, a 2-benzthiazolyl group, a 2-benzoxazolyl group and 5-quinolyl group as the heterocyclic group; an amidinyl group; a sulfanil group; a cyano group; and a hydrogen atom, and $R^1$ and $R^2$ is coupled with each other to form a ring such as malonylguanidine and guanidine.

Specific examples of the compounds having a unit of $$-NH-\overset{\overset{\displaystyle NH}{\|}}{C}-NH-$$

include diphenylguanidine, o-, m- or p-acetylphenylguanidine, bis(p-methoxyphenyl)guanidine, bis(2-methylphenyl)guanidine, 4-aminophenylguanidine, methylguanidine, octylguanidine, 4-aminobutylguanidine, arginine, N-amidinoalanine, dicyclohexylguanidine, 2-benzimidazolylguanidine, 2-imidazolylguanidine, 2-benzothiazolylguanidine, benzoselenazoylguanidine, 4-morphorinylguanidine, 5-quinolinylguanidine, 2-pyrimidinylguanidine, malonylguanidine, guanoxan, methylthioethylguanidine, guanylguanidine, dimethlyguanylguanidine, sulfaguanidine, nitrosulfanilguanidine, butylsulfanilguanidine, (N-acetylsulfanil)phenylguanidine, glycocyamine, cyanoguanidine, aminoguanidine, aminonitroguanidine, guanine, N-phenyl-N'-cyanoguanidine, N-(4-methylphenyl)-N'-cyanoguanidine, N-(4-methoxyphenyl)-N'-cyanoguanidine, N,N'-bis(4-ethoxyphenyl)guanidine, dodecylguanidine, N-dodecyl-N'-cyanoguanidine, N-octyl-N'-cyanoguanidine, octadodecylguanidine, 2-mercaptoethylguanidine, N-mercaptoethyl-N'-methylguanidine, cyclohexylguanidine, (5-methyl-1H-benzimidazole-2-yl)guanidine, N-(4,5-dihydro-1H-imidazole-2-yl)-N'-[(4-methoxyphenyl)ethyl]guanidine, 2-benzoxazolylguanidine, guanacline, 2-tolylbiguanido, N-acteylsulfaguanidine, N,N'-dicyanoguanidine, their salts of hydrochloric acid, carbonic acid, acetic acid, sulfuric acid or phosphoric acid and any mixtures thereof.

The amount of the compound having a unit of $$-NH-\overset{\overset{\displaystyle NH}{\|}}{C}-NH-$$

which can be employed in this invention typically ranges from about 0.03 mole to about 2 moles and preferable from about 0.1 mole to about 0.4 mole based on the mole of the organic silver salt oxidizing agent.

In addition to the above-described components (a), (b), (c) and (d) of the heat developable silver image forming materials according to this invention, the image forming materials of this invention may contain conventional modifiers such as a toner for silver images, an anti-foggant for heat development, a background-darkening preventive agent, a spectral sensitizer and a chemical sensitizer.

For example, phthalazinone, mercuric acetate, 1,2,3,4-tetrabromobutane, merocyanine, N-methyl-2-pyrrolidone are preferably employed as the toner for silver images, the anti-foggant for heat development, the spectral sensitizer and the chemical sensitizer, respectively, in the heat developable silver image forming materials of this invention.

In many cases a binder is required fo shaping the heat developable silver image forming materials of this invention into a film. However, when the components (a), (b), (c) and (d) of this invention act as the binder, use of a binder can be omitted.

Exemplary binders which can be used in this invention include polyvinyl butyrals, polyvinyl formals, polyacrylamides, polymethyl methacrylates, polyvinyl acetates, ethylcelluloses, cellulose acetates, cellulose acetate butyrates, cellulose acetate propionates, polystyrenes, polyvinyl pyrrolidones, polyisoprenes, butadien-styrene copolymers, vinyl acetate-vinylchloride copolymers, polyvinyl alcohols, gelatin and any mixtures thereof. The binder can be used generally in such an amount that the weight ratio of the binder to the organic silver salt oxidizing agent ranges from about 0.1 to about 10.

For example, a heat developable dry image forming material of this invention may be prepared by dispersing or suspending the organic silver salt oxidizing agent prepared separately into a binder solution or binder emulsion by a sand grinder, a mixer or a ball mill, mixing the other components of this invention and if necessary or if desired, other additives with the resulting emulsion, coating the emulsion thus prepared on a support by conventional method to form a layer of the heat developable silver image forming material and drying the layer. Also, the components of the heat developable silver image forming material may be coated on a support in a plurality of layers in any combinations.

Exemplary support which can be used in this invention include plastics films such as cellulose acetate films, polyester films, polyamide films, polyimide films, polyviny acetal films, polystyrene films and polycarbonate films; glass plates; papers such as photographic base paper, coated paper, art paper, barite paper, waterproof paper and ordinary paper; and metal plates such as aluminum plates.

The thickness of the layer or layers of the heat developable silver image forming material dried typically ranges from about 1$\mu$ to about 1000$\mu$.

For the imagewise exposure to light there can be employed various light sources such as tungsten lamps, fluorescent lamps, xenon lamps, mercury lamps, iodine lamps and CRT light sources. Exemplary methods of the imagewise exposure to light include photographing with a camera, projective exposure, contact exposure by placing a manuscript on the image forming material and enlarging exposure. The period of time of the imagewise exposure to light varies depending upon the light source selected and typically ranges from about one hundredth of second to about 10 seconds.

The temperature of the heat development which can be used typically ranges from about 80° C. to about 130° C. and the period of time of the heat development varies depending upon the temperature of the heat development selected and typically ranges from about 1 second to about 60 seconds.

Of the heat developable silver image forming materials of this invention, the post activable type heat developable silver image forming materials can be rendered photosensitive by heating at a temperature of about 80° C. to about 130° C. for about 1 second to about 5 seconds prior to or during the imagewise exposure to light. The temperature of the preliminary heating prior to the imagewise exposure to light in order to render the post activable type heat developable silver image forming materials of this invention photosensitive may be the same as or lower than that of the heat development. Either in the heat development or in the preliminary heating, the period of time of heating becomes shorter with increased temperatures. Images can also be formed by heating the post activable type heat developable silver forming materials of this invention at one time at an appropriate temperaure for an appropriate period of time during the imagewise exposure to light.

The heat developable silver image forming materials of this invention can also be used as a heat sensitive material by conducting an imagewise heating under exposure to light.

The follow Examples are given to illustrate the invention more specifically. However, it should be understood that the invention is in no way limited by these Examples. All parts and percentages in these Examples are by weight.

EXAMPLE 1

8.5 g of behenic acid were dissolved under heating in 150 ml of ethanol with stirring and to the solution was added dropwise a 100 ml aqueous sodium hydroxide solution containing 1 g of sodium hydroxide under heating with stirring to give sodium behenate. Then, 200 ml of hot water were added thereto and the sodium behenate was completely dissolved with continuation of heeating and stirring. Subsequently, an aqueous nitric acid acidic solution containing silver nitrate in an amount equimolar to the behenic acid used was added dropwise under heating with stirring to convert the sodium behenate dissolved to insoluble silver behenate. The silver behenate thus obtained was recovered by filtration and repeatedly washed with hot water and hot ethanol, followed by drying.

To 88 parts of a mixed liquid of methyl ethyl ketone and toluene in a weight ratio of 2 to 1 were added 12 parts by weight of the silver behenate obtained, and the mixture was ball-milled for 24 hours to give a uniform silver behenate suspension.

An emulsion was prepared by adding 4.72 g of a methyl ethyl ketone solution containing 15 percent of polyvinyl butyral to 6 g of the silver behenate suspension with stirring; adding 0.36 ml of a mixed solution obtained by mixing 10 ml of 48 percent hydrogen bromide with 78 ml of methanol to the mixture formed with stirring; continuing to stir the resulting mixture for 30 minutes; adding 0.04 ml of a methanol solution obtained by dissolving 1.8 g of silver bromide in 10 ml of methanol to the mixture with stirring; and adding 20 mg of cyanoguanidine to the mixture produced.

The emulsion thus obtained was coated on a polyester film as the first layer in a wet thickness of 100 $\mu$ and dried at 70° C. for 5 minutes.

Another emulsion having Composition I as set forth below was coated on the first layer in a wet thickness of 100$\mu$ and dried at room temperature to obtain an image forming material A.

| Composition I | |
|---|---|
| Methyl ethyl ketone | 8.3 g |
| Copolymer of vinyl acetate and vinyl chloride | 0.63 g |
| Phthalazinone | 0.14 g |
| 2,2'-Methylenebis(4-ethyl-6-tert-butylphenol) | 0.35 g |

For comparison with the image forming material A, another image forming material B was prepared in the same manner as described above except that the cyanoguanidine was omitted from the first layer.

The image forming materials A and B were exposed to a light of illumination intensity of 2,000 luxes from a tungsten lamp through a 21-step steptablet (manufactured and sold by Eastman Kodak Co., Ltd.) for one second and then heat-developed at 120° C. for 5 seconds to give a clear black image, respectively.

From the optical density of the image formed and the quantity of exposure was made a photographic characteristic curve from which a quantity of exposure necessary for obtaining the optical density 0.6 higher than the total amount of the optical density of the polyester film as a support and that of fog by heat development was determined, and the reciprocal of the quantity of exposure thus determined was obtained as a relative sensitivity of image forming material.

As a result, the relative sensitivity of the image forming material A was 10 times higher than that of the image forming material B.

EXAMPLE 2

An emulsion having Composition II as set forth below was prepared by each of the ingredients of Composition II with stirring and coated on a polyester film as the first layer in a wet thickness of 100$\mu$ and then dried at room temperature.

| Composition II | |
|---|---|
| The same silver behenate suspension as in Example 1 | 6.0 g |
| Methyl ethyl ketone solution containing 15 percent of polyvinyl butyral | 4.72 g |
| N-Bromosuccinimide | 0.025 g |
| 1,3-Diphenylguanidine | 0.04 g |

Then, another emulsion having composition III as set forth below was prepared and coated on the first layer as the second layer in a wet thickness of 100$\mu$ and then dried at room temperature to give an image forming material C.

| Composition III | |
|---|---|
| Acetone | 8.3 g |
| Cellulose acetate | 0.63 g |
| Phthalazinone | 0.14 g |
| 2,2'-Methylenebis(4-ethyl-6-tert-butylphenol) | 0.35 g |

Another image forming material D was prepared in the same manner as described above except that the 1,3-diphenylguanidine was omitted from the first layer.

The image forming materials C and D were preliminarily heated at 100° C. for 3 seconds, exposed to light in the same manner as in Example 1 and then heat-developed at 120° C. for 5 seconds to give an image, respectively.

Then, the relative sensitivity of the image forming materials C and D was determined in the same manner as in Example 1. The relative sensitivity of the image forming material C is 8 times higher than that of the image forming material D.

EXAMPLE 3

An emulsion having Composition IV as set forth below was prepared by mixing each of the ingredients of Composition IV with stirring and coated on a polyester film as the first layer in a wet thickness of 100$\mu$, and then dried at room temperature.

| Composition IV | |
|---|---|
| The same silver behenate suspension as in Example 1 | 6.0 g |
| Methyl ethyl ketone solution containing 15 percent of polyvinylbutyral | 4.72 g |
| Methanol solution containing 5 mg of mercuric acetate | 0.6 ml |
| 1,2,3,4-Tetrabromobutane | 0.096 g |
| N-Iodosuccinimide | 0.04 g |
| N-Methyl-2-pyrrolidone | 1.5 g |

-continued

| Composition IV | |
|---|---|
| Cyanoguanidine | 0.04 g |

Then, the same emulsion as the emulsion having Composition III in Example 2 was coated on the first layer as the second layer in a wet thickness of 100μ, and then dried to give an image forming material E.

Then, another image forming material F was prepared in the same manner as described above except that the cyanoguanidine was omitted from the first layer.

The relative sensitivity of the image foring materials E and F was determined in the same manner as in Example 2.

Further, the image forming materials E and F were exposed to light in a xenon fadeometer ("FadeometerXF-1," manufactured by Suga Shikenki Co., Ltd.) for 2 hours prior to the imagewise exposure to light to test their light stability, and subsequently the relative sensitivity of the image forming materials after the light stability test was determined in the same manner as in Example 2.

As a result, the sensitivity of the image forming material F was remarkably changed by the storage stability test and the relative sensitivity of the image forming material F after the light stability test was about 5 times higher than that without the light stability test. This change in the sensitivity is disadvantageous from the viewpoint of the storage stability of an image forming material.

On the other hand, the relative sensitivity of the image forming material E after the light stability test was the same as that without the light stability test, that is, its sensitivity was kept constant. Thus, it can be clearly seen that the image forming material E according to this invention is excellent in its light stability for keeping the sensitivity constant.

EXAMPLE 4

Four image forming materials G, H, I and J were prepared in the same manner as in Example 3 except that Composition V as set forth below was used instead of Composition IV in Example 3.

| Composition V | |
|---|---|
| The same silver behenate supension as in Example 1 | 6.0 g |
| Methyl ethyl ketone solution containing 15 percent of polyvinyl butyral | 4.72 g |
| Methanol solution containing 10 mg of mercuric acetate | 0.6 ml |
| 1,2,3,4-Tetrabromobutane | 0.096 g |
| Triphenyl phosphite | 0.020 g |
| Iodine | 0.060 g |
| N-Methyl-2-pyrrolidone | 1.5 g |
| Compound having a unit of $-NH-\overset{\overset{\displaystyle NH}{\|}}{C}-NH-$ in an amount as set forth in Table 1 below | |

Then, the relative sensitivity of each of the image forming materials was determined in the same manner as in Example 2. The relative sensitivity of the image forming material J thus determined was evaluated as 1 and the relative value of the relative sensitivity of each of the image forming materials G, H and I are shown in Table 1 below.

Also, the relative sensitivity of each of the image forming materials after the same light stability test as in Example 3 was determined in the same manner as in Example 2. The ratio of the relative sensitivity of each of the image forming materials after the light stability test to that without the light stability test is shown in Table 1 below.

TABLE 1

| Image Forming Material | Compound Having a Unit of $-NH-\overset{\overset{\displaystyle NH}{\|}}{C}-NH-$ | (g) | Relative Value of Relative Sensitivity | Ratio of Relative Sensitivity |
|---|---|---|---|---|
| G | Cyanoguanidine | 0.04 | 10 | 1.0 |
| H | 1,3-Diphenyl-guanidine | 0.04 | 8 | 1.2 |
| I | Guanine | 0.015 | 5 | 1.4 |
| J | None | 0 | 1 | 5 |

EXAMPLE 5

A uniform silver stearate suspension was prepared in the same manner as in Example 1 except that stearic acid was used instead of the behenic acid.

A dry image forming material K was prepared in the same manner as in Example 1 except that the silver stearate suspension, N-cyano-N'-phenylguanidine and 2,6-methylenebis(2-hydroxy-3-tert-butyl-5-methylphenyl)-4-methylphenol were used instead of the silver behenate suspension, the cyanoguanidine and the 2,2'-methylenebis(4-ethyl-6-tert-butylphenol), respectively.

Further, another image forming material L was prepared in the same manner as described above except that the N-cyano-N'-phenylguanidine was omitted.

The relative sensitivity of each of the image forming materials thus obtained was determined in the same manner as in Example 1 and as a result, the relative sensitivity of the image forming material K was 8 times higher than that of the image forming material L.

In order to test the storage stability of the image forming materials K and L, they were kept for one day at a temperature of 50° C. at a relative humidity of 90% in a dark room, and then the relative sensitivity were determined in the same manner as in Example 1. As a result, the sensitivity of the image forming material L decreased while that of the image forming material K according to this invention did not change. The minimum optical density (fog density) of the image obtained from the image forming material K after the storage stability test was the same as that without the storage stability test.

EXAMPLE 6

Five dry image forming materials, M, N, O, P and Q were prepared in the same manner as in Example 3 except that Composition VI as set forth below was used instead of Composition IV in Example 3.

| Composition VI | |
|---|---|
| The same silver behenate suspension as in Example I | 6.0 g |
| Methyl ethyl ketone solution containing 15 percent of polyvinyl butyral | 4.72 g |
| Methanol solution containing 10 mg of mercuric acetate | 0.6 ml |
| 1,2,3,4-Tetrabromobutane | 0.096 g |

-continued

| Composition VI | |
|---|---|
| N-bromosuccinimide | 0.012 g |
| N-Iodosuccinimide | 0.02 g |
| N-Methyl-2-pyrrolidone | 1.5 g |
| Compound having a unit of $-NH-\overset{\overset{NH}{\|}}{C}-NH-$ as set forth in Table 2 | 15 percent by mole per mole of silver behenate |

The relative sensitivity of each of the image forming materials was determined in the same manner as in Example 2. The relative sensitivity of the image forming material Q thus determined was evaluated as 1 and the relative value of the relative sensitivity of each of the image forming materials M, N, O and P is shown in Table 2 below.

Also, the relative sensitivity of each of the image forming materials after the same light stability test as in Example 3 was determined in the same manner as in Example 2. The ratio of the relative sensitivity of each of the image forming materials after the light stability test to that without the light stability test is shown in Table 2.

Further, the minimum optical density of the image formed from each of the image forming materials after the light stability test is also shown in Table 2.

TABLE 2

| Image Forming Material | Compound Having a Unit of $-NH-\overset{\overset{NH}{\|}}{C}-NH-$ | Relative Value of Relative Sensitivity | Ratio of Relative Sensitivity | Minimum Optical Density of Image |
|---|---|---|---|---|
| M | Dicyclohexylguanidine | 5 | 1.0 | 0.9 |
| N | N-Octyl-N'-cyanoguanidine | 7 | 0.9 | 0.10 |
| O | Malonylguanine | 10 | 1.1 | 0.10 |
| P | Glycocyamine | 8 | 1.0 | 0.09 |
| Q | None | 1 | 0.5 | 0.35 |

From Table 2, it can be clearly seen that the image forming materials of this invention are excellent in their sensitivity and storage stability.

While the invention has been described in detail and with reference to specific embodiments thereof, it will be apparent to one skilled in the art that various changes and modifications can be made therein without departing from the spirit and scope thereof.

What is claimed is:

1. A post-activatable heat developable silver image forming material comprising:

(a) a silver salt of a long chain aliphatic carboxlic acid having 12 to 24 carbon atoms;

(b) at least one member selected from the group consisting of (i) organic haloamides having a unit of —CONX— or —$SO_2NX$, wherein X represents a chlorine atom, a bromine atom or an iodine atom, (ii) iodine, and (iii) a compound or a composition comprising a halogen atom as a halogen component and an organic component containing an element of Groups IV, V or VI of the Periodic Table excluding sulfur and whose atomic number is 14 or more, said member being capable of forming a photosensitive silver compound by reaction of 0.01 to 0.5 mole thereof with 1 mole of the silver salt (a);

(c) a reducing agent for silver ion in an amount of 0.1 percent by weight to 200 percent by weight based on the weight of the silver salt (a); and (d) a compound in an amount of 0.03 mole to 2 moles based on the mole of the silver salt (a), of the formula $$R^1NH-\overset{\overset{NH}{\|}}{C}-NHR^2$$

wherein $R^1$ and $R^2$ independently represent an aryl group; an aryl group substituted with an acetyl group, an amino group, an alkyl group or alkoxy group; an alkyl group; an alkyl group substituted with an amino group, a carboxyl group, a mercapto group or an acetyl group; a cycloalkyl group; a S-, Se-, O- or N-containing heterocyclic group; an amidinyl group; a sulfanil group; a cyano group; an amino group; a nitro group and a hydrogen atom;

malonyl guanidine or guanine.

2. The heat developable silver image forming material as claimed in claim 1, wherein the compound d is a compound of the formula $$R^1NH-\overset{\overset{NH}{\|}}{C}-NHR^2$$

wherein $R^1$ and $R^2$ independently represent a phenyl group, an acetylphenyl group, an aminophenyl group, a methylphenyl group, a methoxyphenyl group, an ethoxyphenyl group, an alkyl group having 1 to 18 carbon atoms, an alkyl group having 1 to 4 carbon atoms substituted with a carboxyl group, an amino group or a mercapto group, a cyclohexyl group, 2-benzimidazolyl group, a 2-benzthiazolyl group, a 2-benzoxazolyl group, 5-quinolyl group, an amidinyl group, a sulfanil group, a cyano group and a hydrogen atom;

malonyl guanidine or guanine.

3. The heat developable silver image forming material as claimed in claim 1, wherein the compound $$R^1NH-\overset{\overset{NH}{\|}}{C}-NHR^2$$

is at least one compound selected from the group consisting of 1,3-diphenylguanidine, cyanoguanidine, N-phenyl-N'-cyanoguanidine, N-octyl-N'-cyanoguanidine, dicyclohexylguanidine, malonylguanidine, guanine and glycocyamine.

4. The heat developable silver image forming material as claimed in claim 3, wherein the compound of the formula, $$R^1NH-\overset{\overset{NH}{\|}}{C}-NHR^2$$

is cyanoguanidine.

5. The heat developable silver image forming material as claimed in claim 3, wherein the compound of the formula,

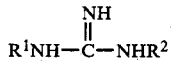

is 1,3-diphenylguanidine.

6. The heat developable silver image forming material as claimed in claim 1, wherein the amount of the compound of the formula,

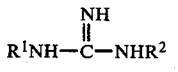

ranges from about 0.1 mole to about 0.4 mole based on the mole of the silver salt.

7. A post activatable type heat developable silver image forming material as claimed in claim 1, wherein (b) is at least one member selected from the group consisting of (i) organic haloamides having a unit of —CONX— or —So$_2$NX—, (ii) iodine, and (iii)

(iii)

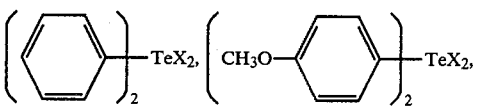

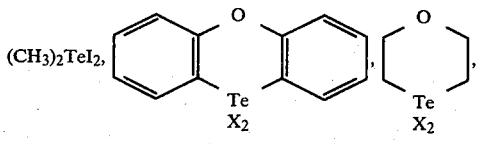

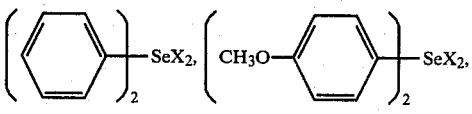

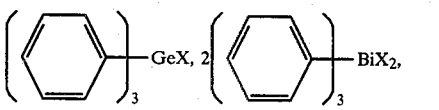

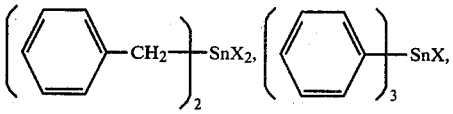

-continued

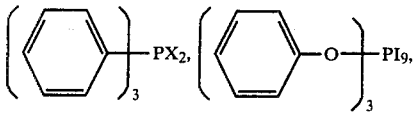

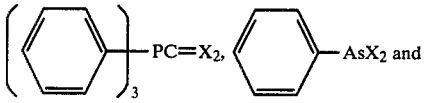

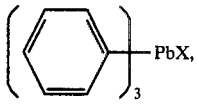

wherein X is a chlorine atom, a bromine atom or an iodine atom; and (iv) a mixture of one of (i), (ii) and (iii) with

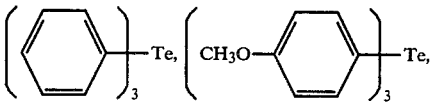

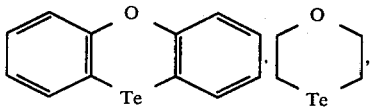

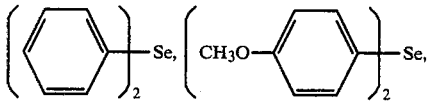

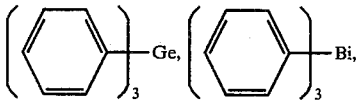

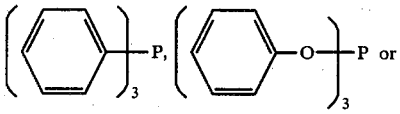

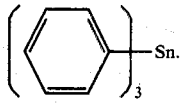

8. The heat developable silver image forming material as claimed in claim 1, wherein (c) is a sterically hindered phenol.

* * * * *